US005607325A

United States Patent [19]

Toma

[11] Patent Number: 5,607,325

[45] Date of Patent: Mar. 4, 1997

[54] CONNECTOR FOR COAXIAL CABLE

[75] Inventor: Stephen J. Toma, Basking Ridge, N.J.

[73] Assignee: Astrolab, Inc., Warren, N.J.

[21] Appl. No.: 490,623

[22] Filed: Jun. 15, 1995

[51] Int. Cl.[6] ..... H01R 11/08

[52] U.S. Cl. ..... 439/578; 439/583; 439/585

[58] Field of Search ..... 437/578, 582, 437/583, 584, 585

[56] References Cited

U.S. PATENT DOCUMENTS

| | | | |
|---|---|---|---|
| 3,196,382 | 7/1965 | Morcello, Jr. | 439/585 |
| 3,710,005 | 1/1973 | French . | |
| 3,963,321 | 6/1976 | Burger et al. . | |
| 4,165,911 | 8/1979 | Laudig | 439/583 |
| 4,408,821 | 10/1983 | Forney, Jr. . | |
| 4,421,377 | 12/1983 | Spinner . | |
| 4,491,685 | 1/1985 | Drew et al. | 439/578 |
| 4,509,816 | 4/1985 | Freitag | 439/585 |
| 4,688,876 | 8/1987 | Morelli | 439/578 |
| 4,698,028 | 10/1987 | Caro et al. | 439/578 |
| 4,772,222 | 9/1988 | Laudig et al. | 439/578 |
| 4,824,400 | 4/1989 | Spinner | 439/578 |
| 4,824,401 | 4/1989 | Spinner . | |
| 4,979,911 | 12/1990 | Spencer . | |
| 5,127,843 | 7/1992 | Henry et al. . | |
| 5,186,655 | 2/1993 | Glenday et al. . | |
| 5,284,449 | 2/1994 | Vaccaro | 439/583 |
| 5,501,615 | 3/1996 | Inaba et al. | 439/578 |

OTHER PUBLICATIONS

Astrolab Control Drawing #29515 dated Jul. 2, 1995.

Military Specification Sheet MIL–C–39012/56C dated Jan. 17, 1983.

Military Specification Sheet MIL–C39012/55E dated Oct. 3, 1986.

Spac Sheet entitled "Specification Data on Right Angle Cable Assemblies".

*Primary Examiner*—Gary E. Elkins

*Attorney, Agent, or Firm*—Gottlieb, Rackman & Reisman, P.C.

[57] ABSTRACT

An electrical connector for terminating flexible coaxial cable is provided. The flexible coaxial cable includes an inner conductor, an intermediate dielectric, an outer flexible braided conductor and an outer insulator. A bored interface body has a first end with a first bore of relatively large inner diameter, a second end with a second bore of relatively smaller inner diameter than the first bore, and a third bore located therebetween of relatively smaller inner diameter than the second bore. A coupling member is located proximate to the interface body. An annular locking member having an inner diameter sized to receive the coaxial cable therein, an outer diameter sized to fit tightly within the first bore of the interface body, a first end having a collar and a second end having a plurality of ribs disposed proximate thereto is provided. This configuration allows for insertion of the second end of the locking member within the first bore of the interface body, so that the ribs of the locking member frictionally engage the inner wall of the first bore to lock the locking member to the interface body.

19 Claims, 6 Drawing Sheets

CONNECTOR FOR COAXIAL CABLE

BACKGROUND OF THE INVENTION

This invention is directed generally to a connector for flexible coaxial cable and, in particular, to an electrical connector for terminating the end of flexible coaxial cable that is relatively small in size and does not require any crimping.

Coaxial connectors have taken many forms in the prior art as exemplified by U.S. Pat. No. 4,408,821 (Forney, Jr.) which is directed to a connector for semi-rigid coaxial cable. The connector for semi-rigid coaxial cable of Forney, Jr. is directed to a connector that does not require crimping. It uses a grip ring having multiple spline fingers extending therefrom and grooves on its inner surface, and a bored tubular shell member having a contoured internal diameter to accept the cable and the grip ring. When the grip ring and cable are inserted into the tubular body, the spline fingers resiliently deflect inwardly along the shell member contour, and embed into the outer semi-rigid cable sheath. This connector system can not provide termination for flexible cables because they do not include a semi-rigid sheath for the spline fingers to embed into.

U.S. Pat. No. 5,186,655 (Glenday, et al.) is directed to an RF connector. This connector locks in place by having a sleeve that is insertable between the outer conductor of a coaxial cable and the inner dielectric, such that the jacket and the outer conductor are deformed. After the sleeve is inserted, a coupling nut is then moved into place and frictionally engages the sleeve. This invention suffers deficiencies in the manner that the jacket electrically connects with the outer conductor, and the way that the coupling nut is coupled to the sleeve. The Glenday, et al. invention can not provide electrical performance for microwave frequencies because the method of deforming the plastic jacket on the outer conductor does not provide sufficient electrical contact at microwave frequencies. Therefore, this connector can not be used for microwave transmission, and is useful only for frequencies up to a few hundred MHz (CATV).

In today's electronic marketplace, microwave communication systems (i.e., cellular systems and point-to-point microwave radios) and the relative packaging of these systems require miniaturization, and dense packaging of electronic elements within small cases. Accordingly, when a system is designed, the designers often desire flexible coaxial cable in order to easily manipulate the cable, and further require miniaturization of the connector elements therefor.

The first attempts at low profile connectors for flexible coaxial cable included right angle connectors which still required crimping. While decreasing the profile of the connector to some extent, this still required a long section of rigid crimped connector, and did not substantially help designers in saving space. Furthermore, the electrical performance of right angle connectors is inferior and requires increased amplification due to VSWR and insertion loss.

Accordingly, it is desirable to provide a connector for flexible coaxial cable that provides a low profile and does not require the usual crimp attachment which increases the profile and limits the design choices. Furthermore, it is required that the connector be able to function at microwave frequencies from DC-24 GHz.

SUMMARY OF THE INVENTION

Generally speaking, in accordance with the present invention, an electrical connector for terminating flexible coaxial cable is provided. The connector includes a bored interface body having a first end with a first bore of relatively large inner diameter, a second end with a second bore of relatively smaller inner diameter than the first bore, and a third bore located therebetween of relatively smaller inner diameter than the second bore. A coupling member is located proximate the interface body and an annular locking member having an inner diameter sized to receive the coaxial cable therein is provided. The locking member has an outer diameter sized to fit tightly within the first bore of the interface body, a first end having a collar and a second end having a plurality of ribs disposed proximate thereto, so that upon insertion of the second end of the locking member within the first bore of the interface body, the ribs frictionally engage the inner wall of the first bore to lock the locking member to the interface body.

Accordingly, by inserting the locking member within the interface body, a single coupling is formed. The coupling member is rotatably coupled to the interface body between the collar of the locking member and an enlarged portion of the interface body.

In the preferred embodiment, the flexible coaxial cable includes an inner conductor, an intermediate dielectric, an outer flexible braided conductor and an outer insulator. The outer insulator is stripped away from the end of the connector, and the outer flexible braided conductor is fanned-out, so that when the locking member is inserted into the interface body, the second end of the locking member bears against the fanned-out flexible conductor and pushes it against an internal wall of the interface body to thereby lock the coaxial cable to the interface body.

It is an object of the present invention to provide a connector for flexible coaxial cable that has a small profile and does not require crimping.

Another object of the present invention is to provide a connector for flexible coaxial cable that provides a transmission medium from direct current to microwave frequencies.

Yet another object of the present invention is to provide flexible coaxial cable that provides the electrical product designer with maximum flexibility.

A further object of the present invention is to provide a connector for coaxial cable that does not require soldering of the outer conductor which may cause dielectric damage; however, the center conductor should be soldered.

Still another object of the invention is to provide a coaxial cable with a profile that is lower than the standard right angle connectors designed for flexible coaxial cable.

Still other objects and advantages of the invention will in part be obvious and will in part be apparent from the specification and drawings.

Accordingly, the invention comprises the features of construction, combination of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENTS

Figure 1:
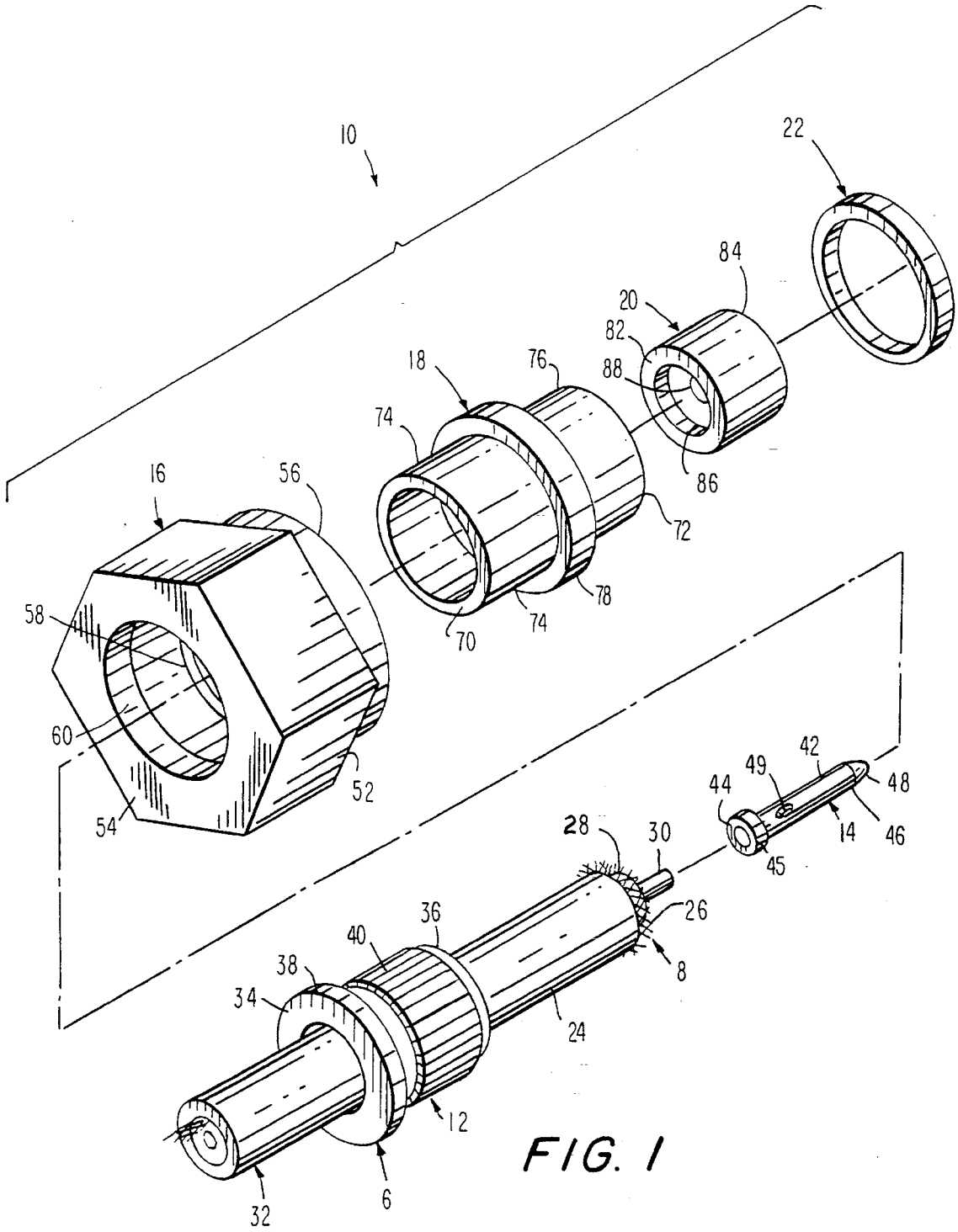
FIG. 1 is an exploded prospective view of the end of a coaxial cable with a connector of the first embodiment of the present invention.

The drawings generally depict an electrical connector for flexible coaxial cable, and specifically a low-profile connector that does not require soldering or crimping of the outer conductor, and operates at microwave frequencies.

In a preferred embodiment of the present invention, the connector is formed with an interface body that is configured to receive the coaxial cable therethrough, along with a bushing that locks the interface body to the coaxial cable.

Reference is now made to FIGS. 1 through 4 of the drawings wherein a first embodiment of an electrical connector, generally indicated at 10 and constructed in accordance with a preferred embodiment of the invention, is depicted. Connector 10 includes a bushing 12, a male contact 14, a coupling nut 16, an interface body 18, an inner insulator 20 and a gasket seal 22. Coaxial cable 32 is formed with an outer insulator 24, an outer braided conductor 26, an inner insulator 28 and an inner conductor 30.

Bushing 12 is an annular member having a continuous inner diameter sized to tightly receive the outer insulator 24 of coaxial cable 32. Bushing 12 includes a first end 34 and a second end 36. A radially-extending collar 38 extends from the first end 34 of bushing 12, and a plurality of axially-extending ribs 40 are located intermediate first end 34 and second end 36. Ribs 40 extend radially outward from the outer surface of bushing 12.

Male contact 14 includes an essentially annular body 42, a first end 44 and a second end 46. A radially outwardly-extending collar 45 is located on first end 44. Second end 46 of male contact 14 terminates in a cone-shaped member 48. Male contact 14 is inserted over inner conductor 30, and may be soldered in place if desired through bore 49 formed in annular body 42. Alternatively, it may be loosely fitted over inner conductor 30, and after assembly of interface body 18, when inner insulator 20 is placed within interface body 18, inner insulator 20 bears against collar 45 and locks male contact 14 in place.

Coupling nut 16 includes a first end 54 and a second end 56. The first end includes a hexagonal outer surface 52, and the second end includes a tubular outer surface of reduced size. The inner surface of coupling nut 16 includes internal threads 58 proximate second end 56, and a radially inwardly-extending collar 60 proximate first end 54.

Interface body 18 is substantially annular and includes a first end 70 and a second end 72. First end 70 is proximate a first annular body section 74 of relatively large internal diameter and second end 72 is located proximate second annular body section 76 which has a relatively smaller internal diameter than first annular body section 74. A third annular body section 78 is located intermediate first annular body section 74 and second annular body section 76 and has a relatively smaller internal diameter than second annular body section 76. Furthermore, the outer diameter of interface body 18 in the regions proximate first annular body section 74 and second annular body section 76 are essentially the same; however, they may vary under different embodiments. The outer diameter in the region proximate the third annular body section 78 is relatively larger than the outer diameter of first annular body section 74 and second annular body section 76.

Inner insulator 20 has a first end 82 and a second end 84. The outer diameter of inner insulator 20 is continuous, and sized to be received within second end 72 of interface body 18. First end 82 includes an internal bore 86 sized to receive inner dielectric 28 of coaxial cable 32. A smaller bore 88 is axially aligned with bore 86, and extends from first end 82 to second end 84 of inner insulator 20. This bore is sized to receive male contact 14 therethrough. However, collar 45 of male contact 14 is larger than bore 88 and accordingly bears against the wall formed at the junction between bore 86 and bore 88, so that male contact 14 is secured in place.

During assembly, coaxial cable 32 must first be prepared by stripping the end of coaxial cable 32, so that only inner conductor 30 is remaining. Next, the outer insulator 24 is stripped off a small portion proximate the end, so that outer braided conducted 26 is visible. The end of coaxial cable 32 is then inserted through first end 34 of bushing 12, so that second end 36 of bushing 12 is proximate the end of coaxial cable 32 that is receiving connector 10. Inner conductor 30 is next inserted into first end 44 of male contact 14. A bore 49 is located in annular body 42 of male contact 14 and is adapted to receive solder, or the like, in order to secure inner conductor 30 within male contact 14.

Figure 2:
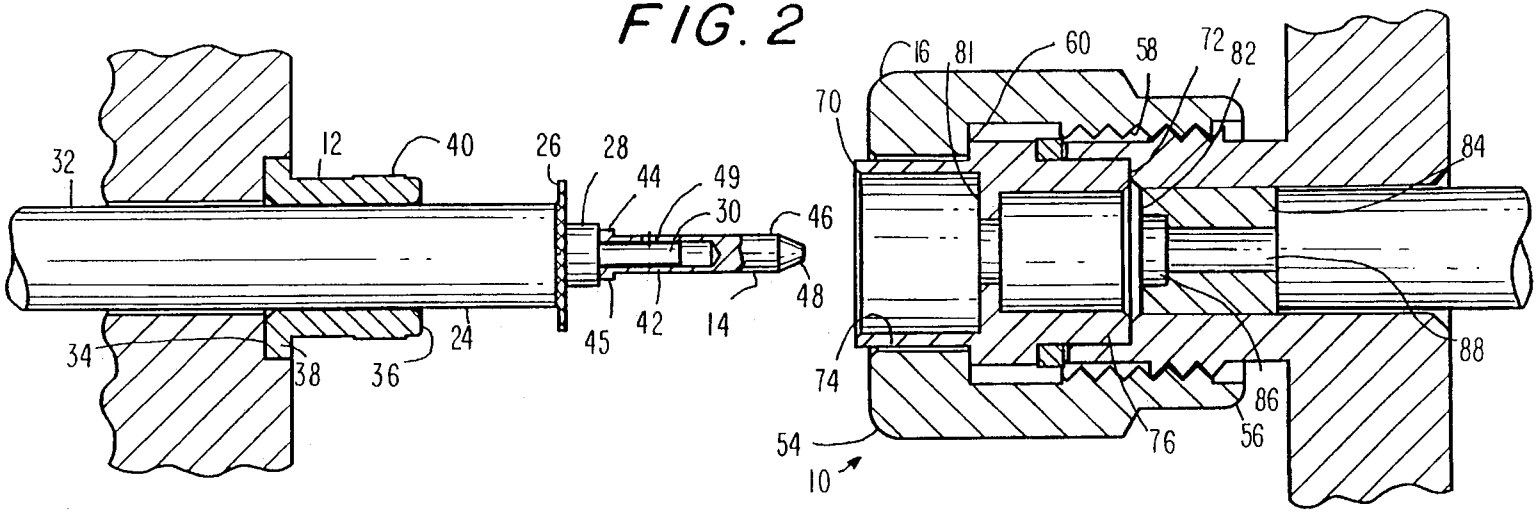
FIG. 2 is a partially-assembled cross-sectional view in accordance with the first embodiment of the invention.
Figure 3:
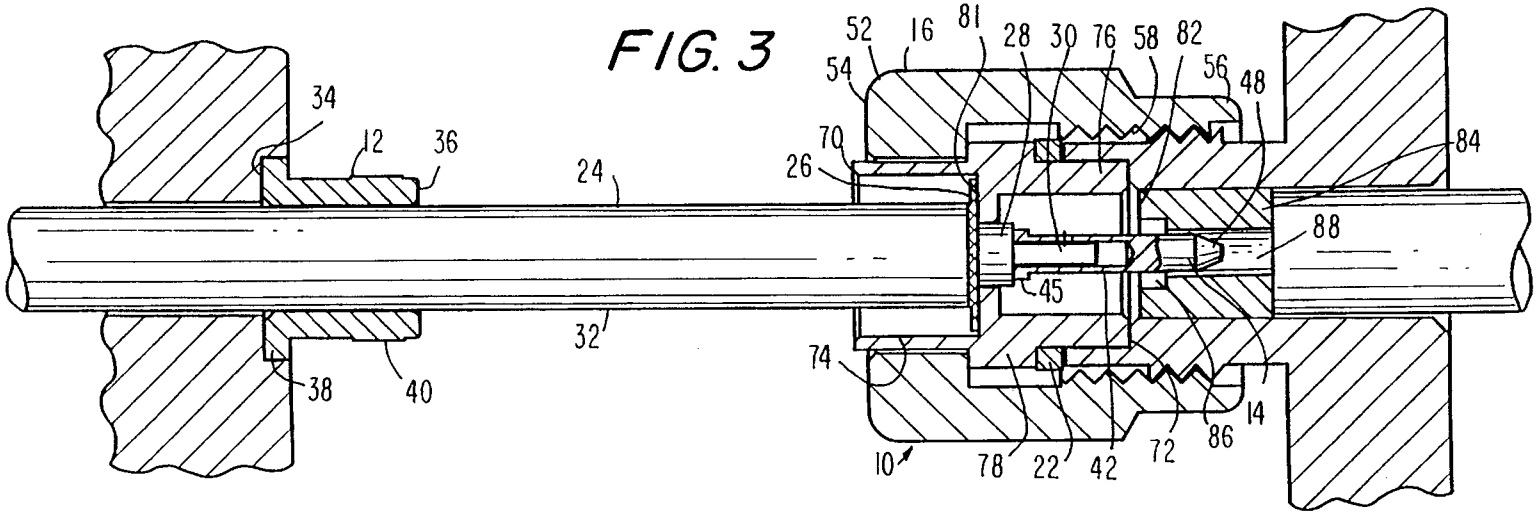
FIG. 3 as a partially-assembled cross-sectional view in accordance with the first embodiment of the present invention.
Figure 4:
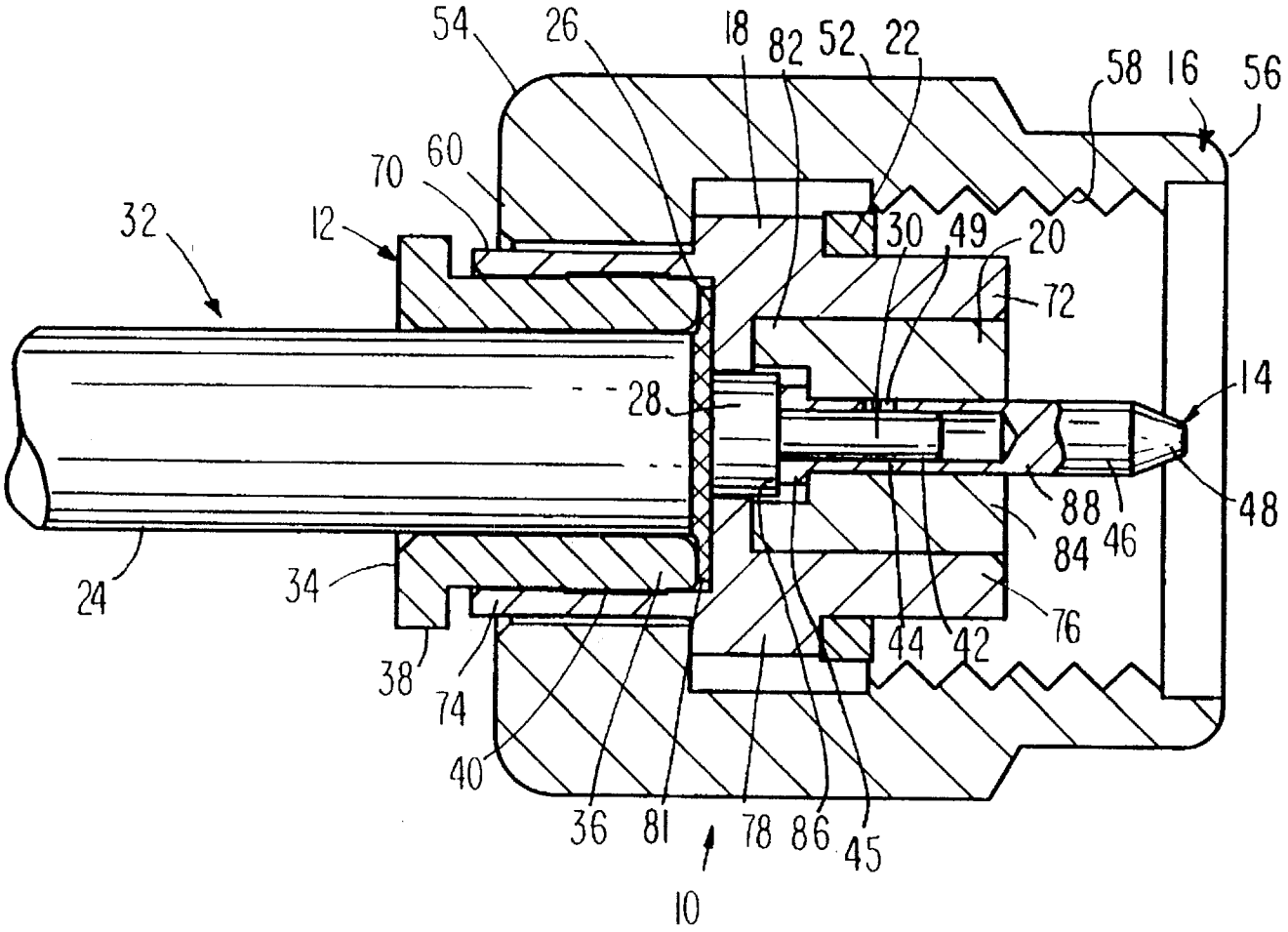
FIG. 4 is a fully-assembled cross-sectional view in accordance with a first embodiment of the present invention.
Figure 5:
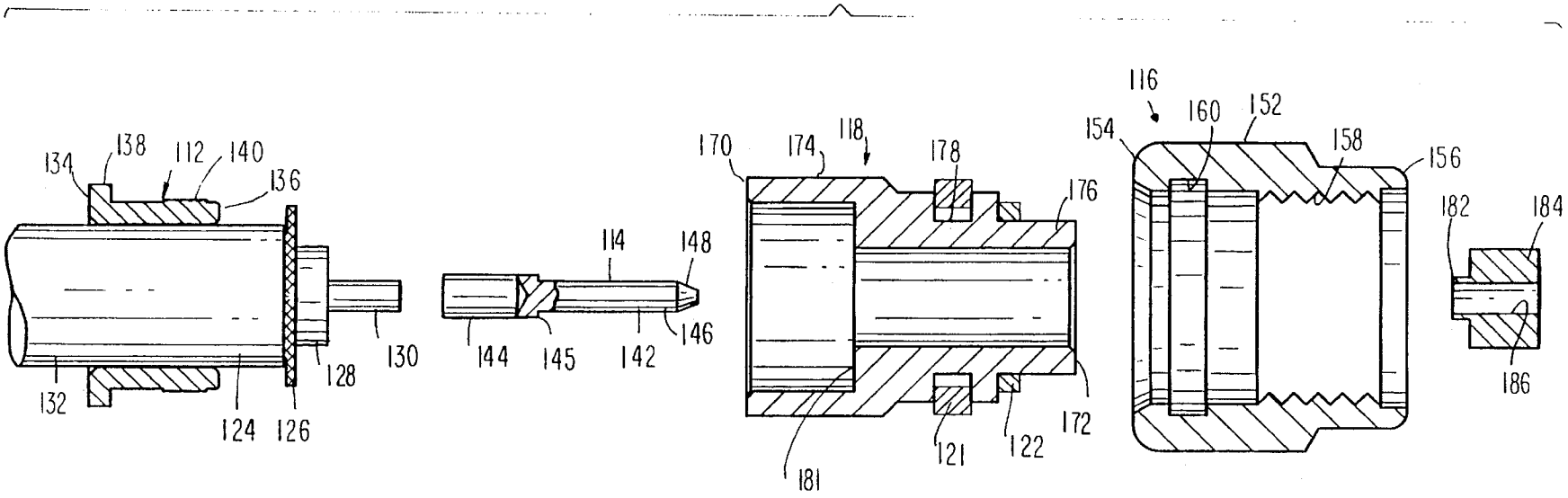
FIG. 5 is an exploded cross-sectional view in accordance with the second embodiment of the invention.
Figure 6:
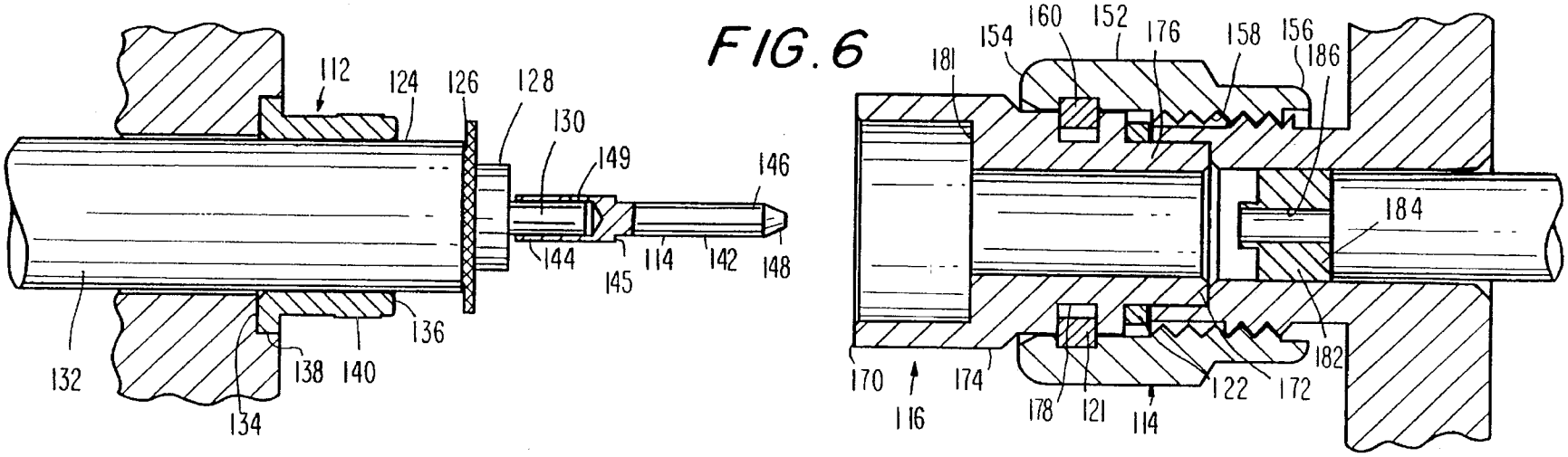
FIG. 6 is a partially cross-sectional view in accordance with the second embodiment of the invention.
Figure 7:
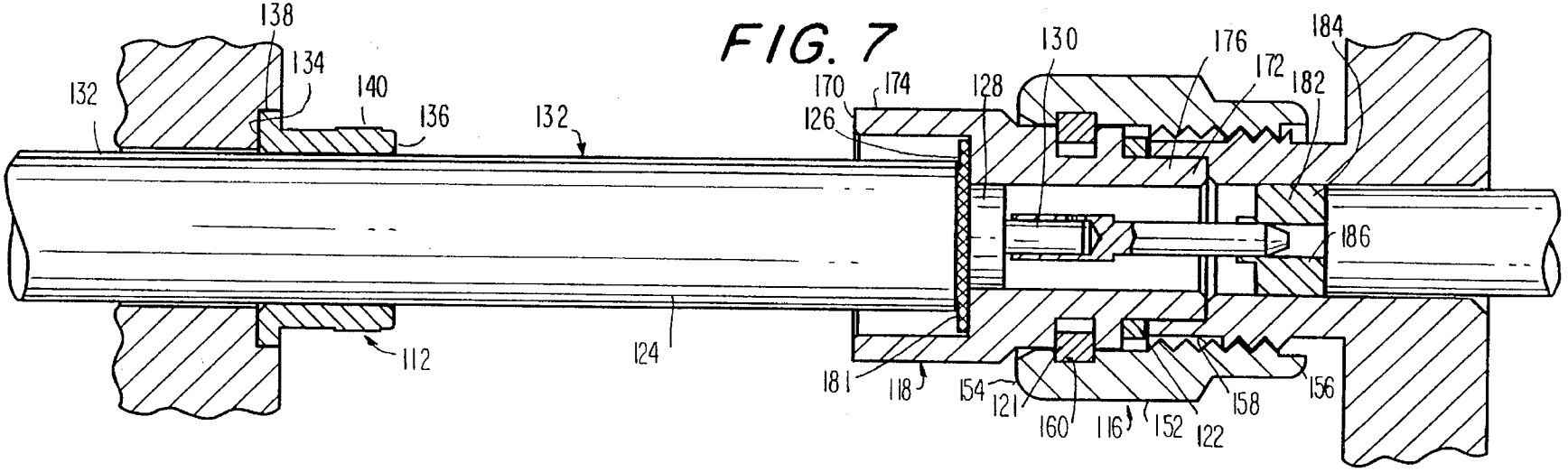
FIG. 7 is a partially-assembled cross-sectional view in accordance with the second embodiment of the present invention.
Figure 8:
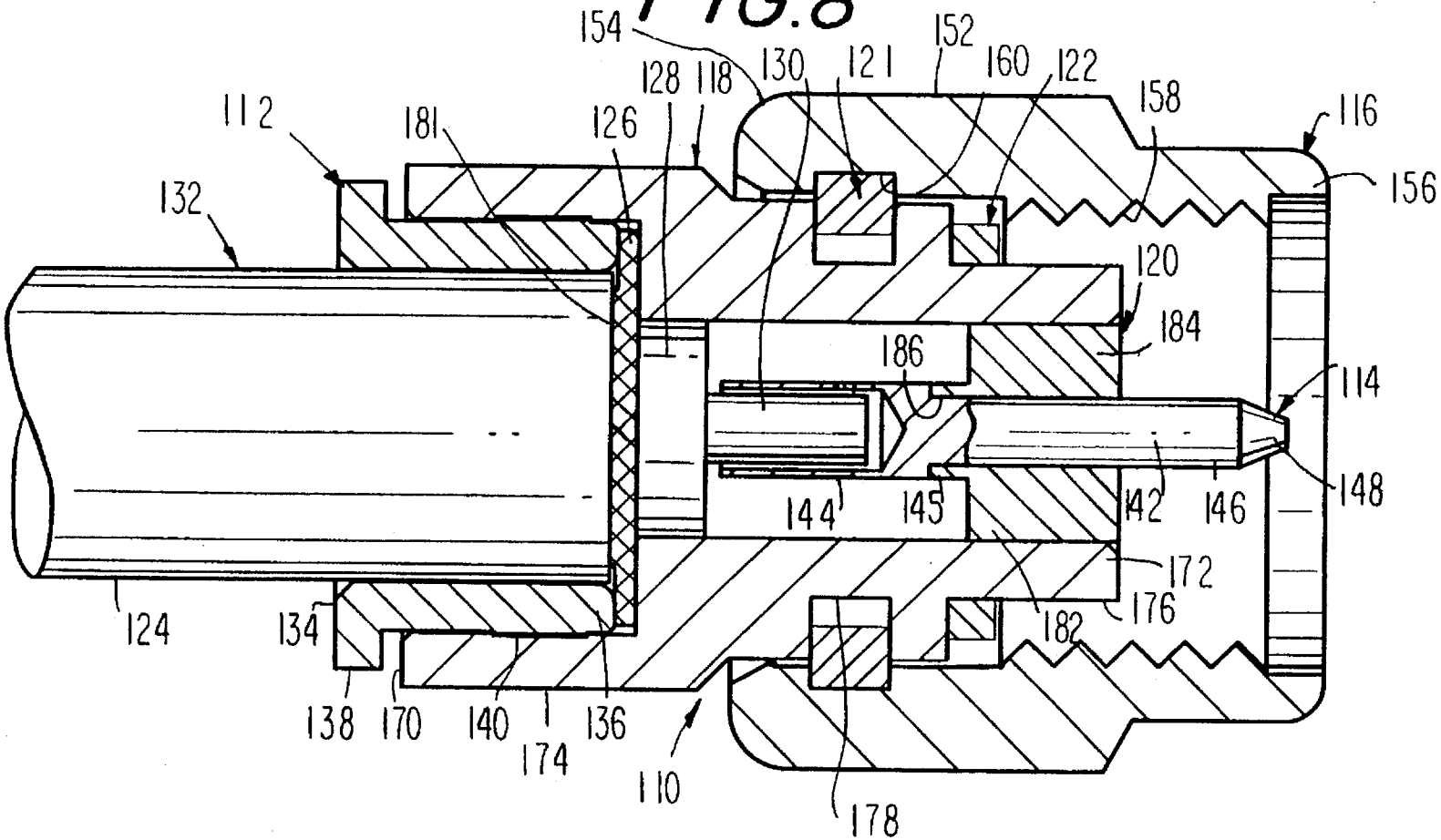
FIG. 8 is a fully-assembled cross-sectional view in accordance with the second embodiment of the present invention.

The outer braided conductor 26 is next fanned in a radially outwardly-extending direction, as depicted in FIGS. 1 and 2. The cable (with fanned outer conductor 26) is inserted through first end 54 of coupling nut 16 and first end 70 of interface body 18. Coupling nut 16 freely moves between collar 38 of bushing 12 and third annular body section 78 of interface body 18. The coaxial cable fits through first end 70 of interface body 18. The inner conductor 30 and inner insulator 28 fit through the bore formed in the third annular body section 78 of interface body 18; however, the fanned-out braid of outer conductor 26 will not fit through third annular section 76. Thus, coaxial cable 32 is only inserted to this point. Bushing 12 is then inserted into first end 54 of coupling nut 16 and first end 70 of interface body 18. This insertion is accomplished by machine or specially designed pincers, and ribs 40 bear against and frictionally engage the inner surface of first annular body section 74, to essentially lock bushing 12 within interface body 18. Upon complete insertion of bushing 12 within interface body 18, second end 36 of bushing 12 bears against the fanned-out braid of outer conductor 28 and against wall 81 of third annular body section 78. Accordingly, this locks coaxial cable 32 to connector 10, and creates electrical contact between outer conductor 26, bushing 12, coupling nut 16 and interface body 18. Next the first end of inner insulator 20 is inserted within second end of interface body 18, and accordingly, male contact 14 extends axially through bore 88 of inner conductor 20. A further gasket 22 is inserted within interface body 18 in the usual manner.

The locking of bushing 12 with interface body 18 rotationally couples coupling nut 16 to coaxial cable 32. This is most clearly seen in FIG. 4, where internally-extending collar 60 is locked between radially outwardly-extending collar 38 of bushing 12 and the outer wall of third annular body section 78 of interface body 18.

Reference is now made to FIGS. 5 through 8 of the drawings wherein a second embodiment of an electrical connector, generally indicated at 110 and constructed in accordance with the invention, is depicted. Connector 110 includes a bushing 112, a male contact 114, a coupling nut 116, an interface body 118, an inner insulator 120, a snap ring 121 and a gasket seal 122.

Bushing 112 is an annular member having a continuous inner diameter sized to tightly receive the outer insulator 124 of coaxial cable 132. Bushing 112 includes a first end 134 and a second end 136. A radially-extending collar 138 extends from the first end 134 of bushing 112, and a plurality of axially-extending ribs 140 are located intermediate first end 134 and second end 136. Ribs 140 extend radially outward from the outer surface of bushing 112.

Male contact 114 includes an essentially annular body 142, a first end 144 and a second end 146. A radially outwardly-extending collar 145 is located on first end 144. Second end 146 of male contact 114 terminates in a cone-shaped member 148. Male contact 114 is inserted over inner conductor 130, and may be soldered in place if desired through bore 149 formed in annular body 142.

Coupling nut 116 includes a first end 154 and a second end 156. The first end includes a hexagonal outer surface 152, and the second end includes a tubular outer surface of reduced size. The inner surface of coupling nut 116 includes internal threads 158 proximate second end 156, and a groove 160 proximate first end 154.

Interface body 118 is substantially annular and includes a first end 170 and a second end 172. First end 170 is proximate a first annular body section 174 of relatively large internal diameter and second end 172 is located proximate second annular body section 176 which has a relatively smaller internal diameter than first annular body section 174. Furthermore, the outer diameter of interface body 118 in the regions proximate first annular body section 174 is larger than the external diameter of second annular body section 176. However, they may vary under different embodiments. A groove 178 is formed in the outer wall of second annular body section 176. When assembled, groove 178 aligns with groove 160, and snap ring 121 which is placed therebetween couples nut 116 to interface body 118.

Inner insulator 120 has a first end 182 and a second end 184. The outer diameter of inner insulator 120 is continuous, and sized to be received within second end 172 of interface body 118. A smaller bore 188 extends from first end 182 to second end 184 of inner insulator 120. This bore is sized to receive male contact 114 therethrough.

The second embodiment is assembled essentially the same as the first embodiment except, coupling nut 116 is rotationally coupled to interface body 118 by snap ring 121. Snap ring 121 is seated between groove 160 of coupling nut 116 and groove 178 of interface body 118.

It will thus be seen that the objects set forth above, among those made apparent from the preceding description, are efficiently attained and, since certain changes may be made in carrying out the above method and in the construction set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An electrical connector for terminating flexible coaxial cable, said flexible coaxial cable including an inner conductor, an intermediate dielectric, an outer flexible braided conductor, and an outer insulator, comprising:

a bored interface body having a first end with a first bore of relatively large inner diameter, a second end with a second bore of relatively smaller inner diameter than said first bore, and a third bore located therebetween of relatively smaller inner diameter than said second bore;

a coupling member proximate said interface body; and an annular locking member having an inner diameter sized to receive said coaxial cable therein, an outer diameter sized to fit tightly within said first bore of said interface body, a first end and a second end, said second end having a plurality of ribs disposed proximate thereto, so that upon insertion of said second end of said locking member within said first bore of said interface body, said ribs frictionally engage the inner wall of said first bore to lock said locking member to said interface body.

2. The electrical connector as claimed in claim 1 wherein a radially-inwardly extending wall exists at least partially between said first bore and said third bore of said bored interface body.

3. The electrical connector as claimed in claim 2 wherein said locking member locks said coaxial cable within said interface body.

4. The electrical connector as claimed in claim 2 wherein said locking member bears against said outer flexible braided conductor and urges same against said radially-inwardly extending wall.

5. The electrical connector as claimed in claim 4 wherein said outer flexible braided conductor is electrically coupled to said coupling means.

6. The electrical connector as claimed in claim 1, said coupling means comprising a nut having an internally threaded portion and an inwardly extending collar.

7. The electrical connector as claimed in claim 6, said bored interface body having a radially outwardly-extending flange proximate said third bore.

8. The electrical connector as claimed in claim 7 wherein said first end of said locking means includes an outwardly extending collar.

9. The electrical connector as claimed in claim 8, wherein said inwardly extending collar of said coupling means is held captive between said outwardly-extended flange of said bored interface body and said collar of said locking means.

10. The electrical connector as claimed in claim 9, wherein said coupling means is rotationally coupled to said coaxial cable.

11. The electrical connector as claimed in claim 1, wherein said coupling means is rotationally coupled to said coaxial cable.

12. The electrical connector as claimed in claim 1, further including a male contact for receiving said inner conductor and providing rigidity thereto.

13. An electrical connector for terminating flexible coaxial cable, said flexible coaxial cable including an inner conductor, an intermediate dielectric, an outer flexible braided conductor, and an outer insulator, comprising:

a bored interface body having a first end with a first bore of relatively large inner diameter and a second end with a second bore of relatively smaller inner diameter adapted to receive said intermediate dielectric therein, and a radially inwardly extending wall formed between said first bore and said second bore;

a coupling member proximate said interface body; and an annular locking member having an inner diameter sized to receive said outer insulator of said coaxial cable therein, an outer diameter sized to fit tightly within said first bore of said interface body, a first end and a second end, said second end being insertable within said first end of said interface body and being adapted to urge said outer flexible braided conductor against said wall to essentially lock said flexible coaxial. cable to said connector.

14. The electrical connector as claimed in claim 13 wherein said connector is adapted for use at microwave frequencies.

15. The electrical connector as claimed in claim 14 further including means for locking said annular locking member to said interface body.

16. The electrical connector as claimed claim 15 wherein said locking means includes a plurality of radially outwardly extending ribs disposed on said locking member.

17. The electrical connector as claimed in claim 13 wherein said outer flexible braided conductor is electrically coupled to said coupling means.

18. The electrical connector as claimed in claim 13, said coupling means comprising a nut having an internally threaded portion.

19. The electrical connector as claimed in claim 13, said interface body including a groove formed in an external surface thereof, said coupling member including a groove formed in an internal surface thereof, and a snap ring located therebetween to couple said interface body to said coupling member.

* * * * *